United States Patent [19]

Maruyama

[11] 4,300,099

[45] Nov. 10, 1981

[54] FIRE DETECTING SYSTEM

[75] Inventor: Masaki Maruyama, Machida, Japan

[73] Assignee: Hochiki Corporation, Tokyo, Japan

[21] Appl. No.: 46,633

[22] Filed: Jun. 7, 1979

[30] Foreign Application Priority Data

Jun. 7, 1978 [JP] Japan ..... 53-67719

[51] Int. Cl.[3] ..... G08B 17/00; G08C 23/00

[52] U.S. Cl. ..... 328/6; 340/517; 340/595

[58] Field of Search ..... 328/6; 340/517, 577, 340/595

[56] References Cited

U.S. PATENT DOCUMENTS 3,995,221 11/1976 MacDonald ..... 328/6

4,052,720 10/1977 McGregor et al. ..... 340/577

4,157,506 6/1979 Spencer ..... 328/6

*Primary Examiner*—John S. Heyman

*Attorney, Agent, or Firm*—Wenderoth, Lind & Ponack

[57] ABSTRACT

A fire detecting system which is capable of successively controlling the forecasting of a fire, setting off alarms and activating fire-extinguishing equipment. The system includes a detector adapted to produce an electric impedance corresponding to an amount of a fire generated object present, such as smoke density, light or heat. An amplifier element has a controlling electrode connected to the detector so as to amplify the change in the electric impedance transmitted by the detector. A voltage-differential actuated element is connected at its one input terminal to the connection terminal of the amplifier element. To the reference input terminal of this voltage-differential actuated element, connected is a reference operation voltage changing means which is controlled by a time constant circuit which is adapted to determine the duration or time length of the output from the voltage-differential actuated element. By so arranging the circuit, a discontinuous or continuous output is produced by the voltage-differential actuated element which is, materially under the control of the reference operation voltage changing means. Therefore, the pattern of the output from the voltage-differential actuated element obtained in accordance with the potentials changed by the reference operation voltage changing means and corresponding to the predetermined amounts of the detected object, provides the information concerning a fire around the detector. The multi-stage information from the detector is used for conducting the control of successive operations of the equipment or functions disposed around the detector such as, for example, the forecasting of a fire, setting off an alarm and activating fire-extinguishing equipments.

6 Claims, 9 Drawing Figures

FIRE DETECTING SYSTEM

BACKGROUND OF THE INVENTION

The present invention is directed to a fire detector which is capable of converting various quantity levels of a detected object (heat, smoke, light and so on) into a predetermined number of fire-stage informations.

The specification of British Pat. No. 1,478,952 discloses an electric circuit for an ion smoke detector or a photoelectric smoke detector, having an output section adapted to deliver two outputs, i.e. a high and a low output, through the switching of the resistance value of a threshold component between low and high values by means of a switching circuit which is constructed such that the operation thereof is limited by a combination of Zener diodes for switching the resistance of the switching circuit between a high and low level depending on the level of voltage applied thereto.

Even when a multiplicity of fire detectors dispersed in a fire prevention zone deliver only two outputs to a central signal receiving device, it is physically impossible to detect a fire occurring in the whole area of the zone or to observe the safe condition of the entire zone with the above described conventional arrangement.

Japanese Patent Laid-open Publication No. 64297/1977 discloses a fire detector in which the operation level of the detector is switched between two stages periodically by an oscillator which is located in the detector.

In the type of fire detector which is adapted to periodically switch the sensitivity over two stages, in order that the receiver can distinguish the fire signals corresponding to the operation levels, the fire signal of one operation level is in the form of pulse signals, while the fire signal of another operation level is in the form of a continuous signal. Therefore, under a condition such that the continuous signal is being delivered as a result of detecting an increasing temperature or smoke density caused by a fire, the fire signal coming from another detector connected to the same detector line cannot be distinguished the signal from the above-described other detector, when the another detector starts to operate. It is impossible to know the number of operating detectors in a detector line, unless an independent signal system is used. The use of the independent signal system, however, renders the detector system complicated and expensive.

SUMMARY OF THE INVENTION

It is therefore an object of the invention to provide a fire detecting system which is capable of converting, without instruction from the central receiving device, the quantity level of the detected object such as heat, smoke, light and so forth into a multiplicity of fire-stage information signals.

It has been found that in order for the fire detecting system to operate satisfactorily, the system should preferably be capable of managing the following five stages of information signals.

1. Precaution Information

This information signal is to inform that the level of heat, smoke density or light has increased unfavourably beyond a predetermined normal level.

2. First Forecasting Information

This information signal is effective to inform an occurrence of the alarm.

3. Second Forecasting Information

This information signal is given when it is judged that a fire is taking place, although not confirmed, to actuate refuge guiding equipment such as refuge guide displays and to hasten the stationing of fire-fighting and security personnel.

4. First Action Information

This information signal is given when the fire is actually confirmed, to generate an alarm to cause people to take refuge and to initiate the fire-fighting operation and action by security personnel, and, at a predetermined time after the alarm, the time being long enough to allow all persons to escape, or at a suitable time in view of the rate of escalation of the fire, to start various fire-fighting equipment such as air-conditioner cut-off, smoke discharging equipment, smoke and fire proof doors and so forth.

5. Second Action Information

This information signal is given to start operation of various fire-fighting equipment such as fire extinguishers.

According to the invention, these useful fire information signals are automatically derived from the fire detecting system, without any instructions given by a central signal receiving device.

The information signals are grouped into three steps of precaution, alarming and fire-fighting or action. Therefore, the number of information signals given by the fire detecting system is suitably and selectively determined, depending on the demand by the application of this system, to enhance the accuracy of the information of each step of precaution, alarming and action.

To this end, the output stage of the electric outputting device for delivering an output corresponding to the quantity level of object is changed by a time constant which permits an effective tracing up of the change of level of quantity the detected object.

Thus, the fire step information signals are created by the length of the time constant, and, in case of ordinary fires with the exception of an explosive one, a discontinuous electric output or the combination of the time constant and the discontinuous electric output.

For instance, the discontinuous outputs are successively accumulated or memorized and the information steps are formed in accordance with the level of the output obtained by such an accumulation or memorization. Recognizing that the occurrence of a plurality of detectors detecting the same amount or quantity level of the detection object seldom happens, the output time of the discontinuous signal may be determined by the time constant which in turn is selectively determined.

Particularly, in order to convert the change in quantity level of the detection object into useful fire stage informations at a low cost, a circuit in which the resistances of a number of subcircuits, which are required for the number of informations and are successively increased or decreased in parallel or series is formed at the reference terminal of a voltage-differential actuated element, and the stepped change of the resistance value is made with different time constants. By so doing, it is possible to cause the information signal of the same fire stage to output the signals of the same time length.

An example of the stages of the output times is shown below.

first forecasting information: 10 ms
second forecasting information: 30 ms
alarming information: 100 ms
action information: 1 sec In ordinary fires, there are intervals of several seconds between each successive information signals. Therefore, even if a plurality of detectors, say 20 or so, are connected in parallel to the power line and signal receiving line, it is possible to discriminate whether the fire is escalating and whether the fire has been extinguished at an early stage of forecasting, as well as the rate of escalation of the fire.

The condition in which the first and second forecasting information signals are generated, in which the actual fire has not yet occurred is often experienced. It is also preferable to arrange the device such that the fire detecting system is reset to the starting condition a predetermined time after the delivery of the forecasting information. The length of this time is suitably selected in view of the time length which is ordinarily experienced, e.g. the time length in which the smoke generated by a burning of a paper in a room is completely extinguished from the room. Thus, this time length typically falls within 1 minute to ten minutes. This arrangement is advantageous in that it permits an easy testing or checking of the safe functioning of the detecting system.

In addition, it is possible to detect a malfunction of a detector or detectors of a system by collecting the stage information signals which have been generated by respective detectors of the system in accordance with respective levels of detected objects. Specifically, if the alarming information which is given suddenly by a detector is not followed by any forecasting information, it is judged that the sudden alarming information is erroneous and the detector from which the sudden alarming information has been derived has been defectively triggered by an invasion of a worm or like foreign object.

The detectors which are capable of outputting staged fire information signals can successively actuate the fire forecasting display, fire alarm and anti-fire equipments which are arranged around respective detectors, through staged information signals of their own, without requiring instruction from the central signal receiving device. Specifically, by attaching a controlling means to the multi-stage output terminals of the detector with the controlling means adapted to impart a suitable control output to the electric actuating means for actuating various equipment, each detecter can function effectively as a total control which adequately manages the equipment around the detector. A result of the above-described invention is that the wiring between a multiplicity of detectors and the central signal receiving and instructing means, as well as the control of the information transmitted therebetween, is very simple and therefore very reliable.

BRIEF DESCRIPTION OF THE DRAWINGS

FIG. 5 is a circuit diagram of a modification of the embodiment shown in FIG. 4, additionally provided with a circuit for preventing erroneous operation at the time of turning the power source on;

DETAILED DESCRIPTION OF THE PREFERRED EMBODIMENTS

Figure 1:
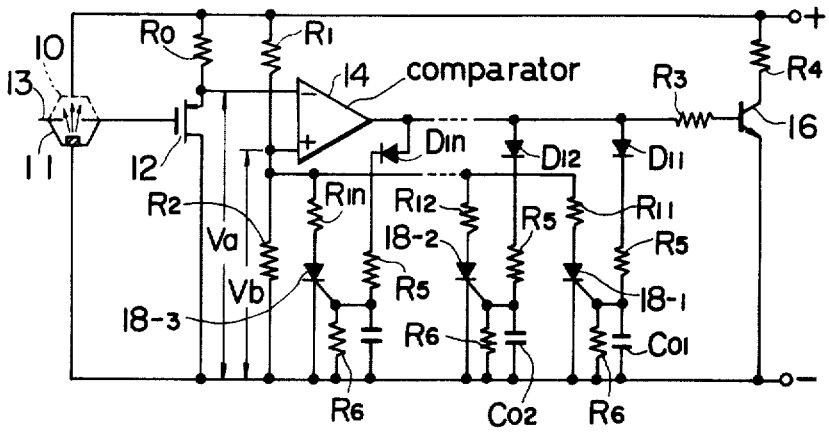
FIG. 1 is a circuit diagram of an embodiment of the invention having a sensitivity changing circuit incorporating thyristors.

Referring to FIG. 1, a detector has an outer chamber 10 for ionizing smoke which is introduced into it by means of a radiant ray source disposed in an inner chamber 11. A fire detecting circuit section made up of a field effect transistor 12 is adapted to produce at its source end a fire detecting signal having a voltage Va which corresponds to the smoke density in the chamber 10 which is picked up by means of an intermediate electrode 13. A voltage comparator 14 is inverted to convert the output to a high level when the detecting voltage Va of the field effect transistor 12 has come down below the level of a discrimination reference voltage Vb which is determined by resistances R1 and R2 which make up a potential dividing circuit. The output of the voltage comparator 14 is connected through a resistance R3 to the base of a transistor 16 which is adapted to be turned on to permit an electric current to flow through a resistance R4 which is connected to the collector of said transistor 16 to thereby deliver a fire signal to the receiver side when the output from the voltage comparator 14 assumes a high level.

The circuit means for changing the sensitivity of the detector, i.e. for changing the discrimination reference voltage by which the operation level of the voltage comparator 14 is changed, is arranged as follows.

Specifically, thyristors 18-1, 18-2, . . . , 18-n are connected in parallel with the resistance R2 of the potential dividing circuit. Resistances $R_{11}$, $R_{12}$, . . . , $R_{1n}$ which have different resistance values are connected in series to respective thyristors 18-1, 18-2, . . . , 18-n. Therefore, the impedance Z of the potential dividing circuit which provides the discrimination reference voltage is determined by the following equation for the equilibrium state in which the thyristors are not turned on.

$$Z_{01} = R2$$

As the thyristors 18-1, 18-2, . . . , 18-n are successively turned on, the impedance is changed successively as determined by the following equations.

$$Z_{011} \approx 1/\left(\frac{1}{R_2} + \frac{1}{R_{11}}\right)$$

$$Z_{03} \approx 1/\left(\frac{1}{R_2} + \frac{1}{R_1} + \frac{1}{R_{12}}\right)$$

-continued $$Z_{0n} \approx 1/\left(\frac{1}{R_2} + \frac{1}{R_{11}} + \frac{1}{R_{12}} + \ldots + \frac{1}{R_{1n}}\right)$$

The values of the resistances are determined so as to be $Z_{01} > Z_{02} > Z_{03} \ldots > Z_{0n}$.

Therefore, as the thyristors are successively turned on, the discrimination reference voltage is gradually lowered in accordance to the change of the impedance $Z_{01}$, $Z_{02} \ldots Z_{0n}$, so that the operation level of the voltage comparator 14 is successively changed.

The gate circuit for turning on the thyristors 18-1, 18-2, . . . , 18-n successively at each time of inversion of the voltage comparator 14 to the higher output level, i.e. at each delivery of the fire signal, is constructed as follows.

A time constant circuit made up of a resistor R5 and a capacitor C01 is associated with the thyristor 18-1. The other thyristors 18-2, . . . , 18-n are associated with time constant circuits which are made up of resistances R5 of the same resistance value as the resistor R5 associated with the thyristor 18-2, . . . 18-n and capacitors C02, . . . , C0n of different capacitances. These time constant circuits are connected to the output terminal of the voltage comparator 14 through diodes $D_{11}$, $D_{12}$, . . . , $D_{1n}$. Further, resistances R6 are connected to the gates of the respective thyristors 18-1, 18-2, . . . , 18-n. In addition, the capacitance values of the capacitors C01, C02, . . . C0n are determined so that the time constants td1, td2, . . . , tdn of the gates of the respective thyristors have values which can be expressed by td1<td2<. . . <tdn.

Figure 2:
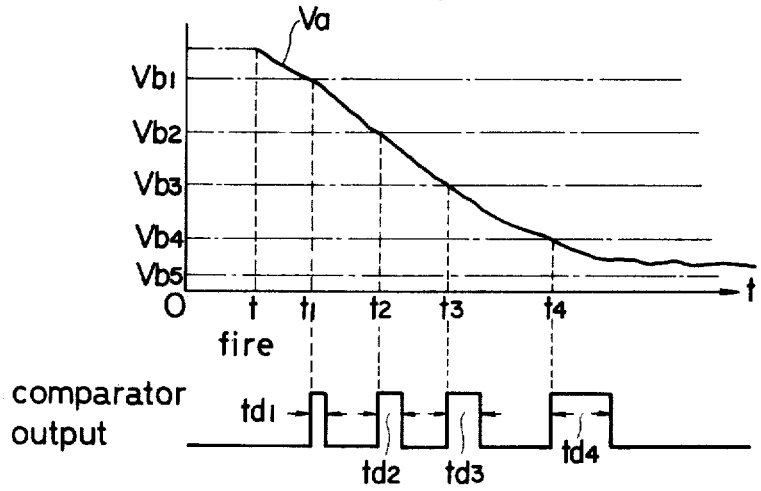
FIG. 2 is a time chart showing the change of sensitivity in relation to time and the fire signal derived from a comparator, in accordance with a change in the fire detecting signal in the embodiment shown in FIG. 1.

Hereinafter, an explanation will be made as to the operation of the fire detector of the embodiment shown in FIG. 1, through an example in which the discrimination reference voltage of the voltage comparator is changed over five stages of Vb1, Vb2, Vb3, Vb4 and Vb5, as shown in FIG. 2, by means of four thyristors 18-1, 18-2, 18-3 and 18-4 and associated gate circuits.

In the normal condition in which there is no smoke in the outer chamber 18, the field effect transistor 12 is conductive because of the gate bias cause by the intermediate electrode 13. In this state, the source voltage Va is equal to the voltage which is obtained by subtracting the voltage drop across the resistance R0 from the source voltage. In addition, since no thyristor has been turned on, the discrimination reference voltage is the divided voltage Vb1 which is determined by the resistances R1 and R2. Since the voltage Va is set at a level sufficiently higher than the voltage Vb1, the output of the voltage comparator 14 is kept substantially at zero level, and the transistor 16 is kept in the off state.

Subsequently, as the smoke comes into the outer chamber 18, the resistance of the field effect transistor 12 is lowered. As a result, the detecting voltage Va is gradually lowered in accordance to the increment of the smoke density as shown in FIG. 12, and finally becomes saturated. The detector functions in the manner described below in response to the change in the detecting voltage Va.

At a moment t1 at which the detecting voltage Va is decreased to a level below the discrimination reference voltage Vb1, the voltage comparator 14 inverts to turn its output to the high level, so that the transistor 16 is turned on to deliver the fire signal.

Simultaneously, the output voltage from the comparator is delivered to the gate circuits of the thyristors 18-1,18-2,18-3, . . . ,18-4 and charging of the capacitors C01,C02, . . .,C03 is commenced through the resistance R5.

Since the time constant td1 of the gate circuit of the thyristor 18-1 is set at a level lower than those of the other circuit, the thyristor 18-1 is turned on due to the charging up of the capacitance C01, before other thyristors are turned on. As a result of the turning on of the thyristor 18-1, the discrimination reference voltage of the voltage comparator 14 is decreased to the level Vb2 which is determined by the parallel impedance of the resistances R2 and R11, so that the detecting voltage Va exceeds the discrimination reference voltage Vb2 to cause the voltage comparator 14 to invert again. As a consequence, the output is reset to the starting zero level and, simultaneously, the transistor 16 is turned off. Subsequently, a current pulse of 2 length or width corresponding to the time constant td1 of the gate circuit of thyristor 18-1 is delivered to the receiver.

As the output of the comparator 14 returns to zero after the turning on of the thyristor 18-1, the capacitor C01 discharges through the resistance R6. Similarly, the capacitors C02, . . . , C04 of the other thyristors discharge through the resistances R6 as the output of the comparator 14 returns to the zero level, so as to prepare for the next sensitivity changing operation. The thyristor 18-1 operates while the ON state is maintained.

Subsequently, at the moment $t_2$ when the detecting voltage Va is decreased below the discrimination reference voltage Vb2 which determines the next level of operation, while the thyristor 18-1 is kept in the conductive state, the voltage comparator 14 is again inverted in the same manner as described before, so as to commence the charging of the capacitors Co1,Co2, . . . , Co4 of the thyristors 18-1,18-2, . . . , 18-4. Since the thyristor 18-1 has already been turned on, the thyristor 18-2 is turned on after a lapse of a time td2 which is determined by the capacitance of the capacitor C02 of the gate circuit of thyristor 18-2, so that the level of operation of the voltage comparator 14 is lowered to the reference voltage Vb3. At this time, a current pulse having a time width td2 is delivered to the receiver.

This operation is repeated and the thyristors 18-3 and 18-4 are successively turned on as the detecting voltage Va drops down below the respective reference voltages Vb3 and Vb4. The discriminaton reference voltage Vb5 determined by the turning on of the final thyristor 18-4 is set at a level lower than the level of saturation of the detecting voltage Va. Therefore, once the discrimination reference voltage Vb5, which determines the final level of operation is reached, the detector is kept in a locked state and does not operate when the detecting voltage is changed within the set density region of the field effect transistor 12. In order to prevent this locked state, it is only required to turn off the thyristors 18-1,18-2, . . . , 18-4. More particularly, the locked state is eliminated by disconnecting the power source of the detector line at the receiver side, or by cutting the anode current of the thyristors by the use of a timer circuit which is started as the thyristor giving the final operation level of the detector is turned on.

As has been described, in the fire detector of the invention, the sensitivity depending on the level of the fire detecting signal is changed over several stages.

Once the detector operates at a preset sensitivity, the repeated operation at the same sensitivity is not allowed, and the detector is switched to another sensitivity. Fire signals of different time lengths are delivered as the detector operates at respective sensitivities. Since these signals can be discriminated or distinguished at the receiver side, it beomes possible to known at what sensitivity the detector is operating.

Particularly, in case of a fire, the change of the sensitivity is accomplished in a staged manner, within the time lengths which are expected from previous experience, and the fire signals at respective sensitivities are successively received. On the other hand, in case of a moistening or invasion by a worm, or in case of invasion by smoke due to reasons other than the fire, only the signals of the first or second stages, which are produced at comparatively high sensitivities, are received by the receiver. It therefore becomes possible to judge exactly whether the delivered information is caused by an actual fire or not, and the reliability of the fire detecting system is remarkably improved.

Even when a plurality of detectors are connected to a common detector circuit, it seldom occurs that two or more detectors operate simultaneously, because these detectors are disposed at suitable distances from one another. Therefore, it is possible to known at the receiver side what the number of the detectors operating is and the sensitivities at which the detectors are operating. This in turn makes it possible to observe direction and order of spread of the fire.

Figure 3:
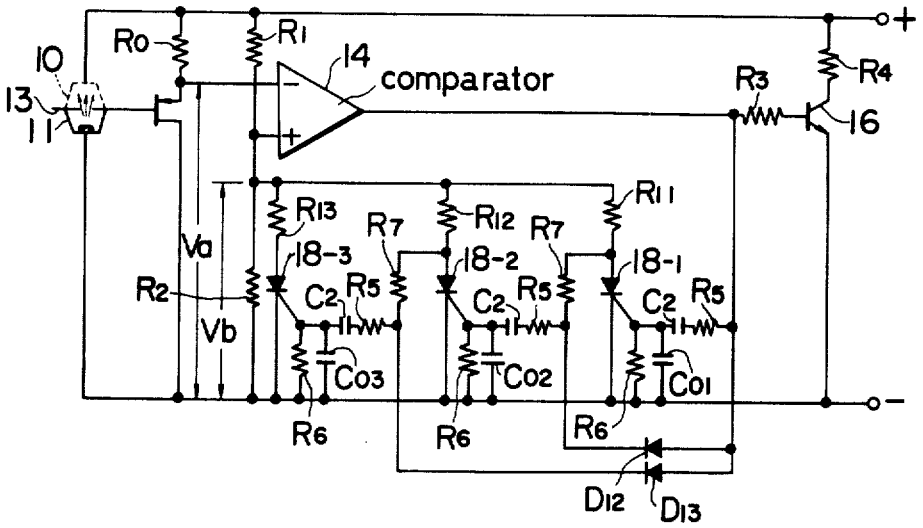
FIG. 3 is a circuit diagram of another embodiment of the invention having a sensitivity changing circuit which includes thyristors.

FIG. 3 shows another embodiment of the invention having a sensitivity changing circuit which includes thyristors. In this embodiment, the sensitivity is changed over four stages by the action of three thyristors. This embodiment has a construction of a gate circuit for each thyristor which is different from that of the embodiment shown in FIG. 1

More specifically, in this embodiment, a coupling capacitor C2 having a large capacitance is connected between the resistance R5 and the capacitor C01 (C02 and C03) of the gate circuit of each thyristor 18-1 (18-2 and 18-3). The gate circuits of the thyristors 18-2 and 18-3 are connected to the anodes of respective preceding thyristors through resistances R7.

In operation, the coupling capacitors C2, with the exception of C2 of the first thyristor 18-1, are charged by the anode potentials of respective thyristors 18-2 and 18-3 through resistances R7.

Then, as the output from the comparator 14 is turned to the high level, the capacitor C01 of the thyristor 18-1 is charged through the resistance R5 and the capacitor C2, while the capacitors C02 and C03 of gate circuits of the other thyristors 18-2 and 18-3 are not charged with the high level output from the comparator, because their coupling capacitors C2 have already been charged, so that the thyristors 18-2 and 18-3 are prevented from being turned on.

As the thyristor 18-1 is turned on, the coupling capacitor C2 in the gate circuit of the thyristor 18-2 discharges so that the capacitor C02 can be charged with the high level output of the comparator 14. It is therefore possible to successively turn on the thyristors 18-1,18-2 and 18-3. Further operation of this embodiment is identical to the operation of the embodiment shown in FIG. 1 and, therefore, is not described here.

Figure 4:
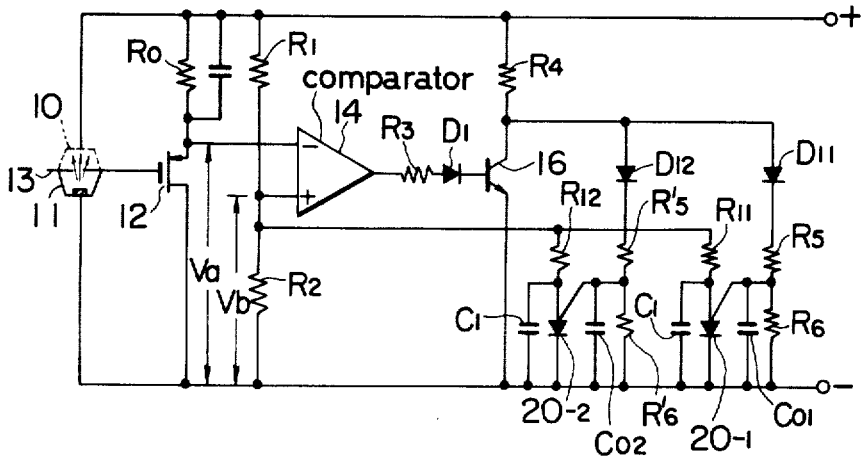
FIG. 4 is a circuit diagram of still another embodiment of the invention having a sensitivity changing circuit which includes programmable unijunction transistors (hereinafter PUTs)

FIG. 4 shows sill another embodiment in which programmable unijunction transistors (referred to as PUT hereinafter) are used as the current controllers for the sensitivity changing circuit by which the discrimination reference voltage of the voltage comparator is changed, and the sensitivity is changed over three stages.

Referring to FIG. 4, the voltage comparator 14 has input terminals with the polarities determined so that the output from the comparator takes is at the zero level in the normal condition as in the embodiment shown in FIG. 1. For this reason, the collector voltage is maintained substantially at the same level as the source voltage of the transistor 16 in the off state.

The PUTs 20-1 and 20-2 are connected in parallel with the resistance R2 of the potential dividing circuit through the resistances $R_{11}$ and $R_{12}$. The discrimination reference voltage is changed when the PUT 20-1 is turned on and when the PUT 20-2 is turned on subsequently to the PUT 20-1 being turned on so as to change the operation level of the detector. The gate circuit for the PUT 20-1 is made up of a time constant circuit which includes resistances $R_5$ and $R_6$ and a capacitor C01. The gate circuit for the PUT 20-2 is made up of a time constant circuit including resistances $R_5'$and $R_6'$ and the capacitor C02. These time constant circuits are connected to the collector of the transistor 16 through diodes $D_{11}$ and $D_{12}$ The time constant of the gate circuit for the PUT 20-1 is selected to be smaller than that of the gate circuit for the PUT 20-2. In order to prevent erroneous operation of the PUTs at the time of turning on of the power source, capacitor $C_1$ is connected between the anode and cathode of each of the PUTs 20-1 and 20-2.

The PUTs 20-1 and 20-2 are adapted to be turned on when the gate potential has been reduced down below the anode potential. If the PUTs are set so that the anode current which is determined by the resistances $R_1$ and $R_2$ is within the region of the thyristor which is out of the oscillation region, the PUTs are locked in the conductive state as is the case when thyristors are used, even when the gate potential is lowered, once they are turned on.

The embodiment shown in FIG. 4 operates in the manner described hereinafter.

In the equilibrium state, the field effect transistor 12 is kept in the conductive state with a high resistance. In this state, the source voltage Va equals the voltage which is obtained by subtracting the voltage drop across the resistance $R_0$ from the power source voltage, and is higher than the discrimination reference voltage Vb1 which is determined by the resistances $R_1$ and $R_2$. Therefore, the output from the voltage comparator 14 is maintained at a zero level. When the transistor 14 has been turned off, the power source voltage is applied to the gate circuits of PUTs 20-1 and 20-2 so as to charge the capacitors $C_{01}$ and $C_{02}$. Since the charging voltage of the capacitors $C_{01}$, $C_{02}$ are higher than the discrimination reference voltage Vb1, both of the PUTs are kept in the off state Subsequently, as the outer chamber 10 is invaded by smoke, the resistance of the field effect transistor 12 is lowered and, at the instant when the detecting voltage Va drops below the level of the discrimination reference voltage Vb1, the voltage comparator 14 inverts to change its output to the high level and thereby turn the transistor 16 on. As a consequence, the power source voltage being applied to the gate circuits of the PUTs 20-1 and 20-2 through the diodes $D_1$ and $D_2$ are cut off.

As a result, the capacitors $C_{01}$ and $C_{02}$ discharge through respective resistances $R_6$. Due to the discharge from the capacitor $C_{01}$ which has a smaller capacitance or time constant, the gate voltage of the PUT 20-1 first drops down below the level of the anode voltage so that the PUT 20-1 is turned on. As a result, the discrimination reference voltage of the voltage comparator 14 drops down to the level Vb2. Consequently, the voltage comparator 14 inverts to reset its output to the zero level and thereby turn the transistor off. As a result, a current pulse having a time width corresponding to the time constant of the gate circuit of the PUT 20-1 is delivered to the receiver side. The other PUT (PUT 20-2) operates in the same manner. The detector is locked when the sensitivity has been changed to the final one as a result of turning on of both PUTs 20-1 and 20-2.

Figure 5:
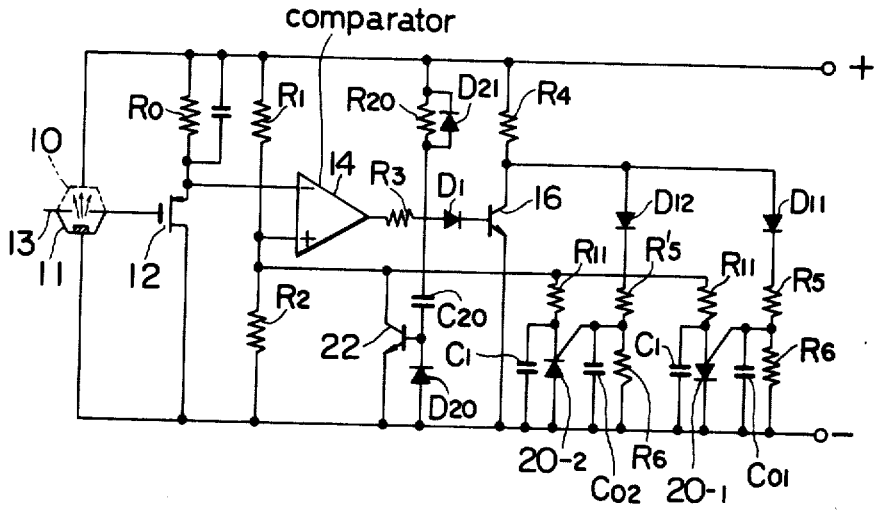

FIG. 5 shows a further embodiment of the invention having a sensitivity changing circuit which uses PUTs. This embodiment is additionally provided with a circuit for preventing erroneous operation of the sensitivity changing circuit at the time of turning on of the power source.

More specifically, a transistor 22 is connected in parallel with the resistance $R_2$ of the potential dividing circuit. A biasing circuit for causing the transistor 22 conduct only in the transient period after the turning on of the power source is made up of a resistance $R_{20}$, capacitor $C_{20}$ and a diode $D_{20}$ which are connected in series, the juncture between the capacitor $C_{20}$ and the cathode of the diode $D_{20}$ being connected to the base of the transistor 22. A diode $D_{21}$, which provides a passage which allows discharge from the capacitor $C_{20}$, is connected in parallel with the resistance $R_{20}$.

The above described circuit for preventing the erroneous operation operates in the manner described below. Simultaneous to the application of the power source voltage, the transistor 22 is turned on by the charging current of the capacitor $C_{20}$ so that the anode potentials of the PUTs 20-1 and 20-1 are lowered to zero level to thereby cut-off the anode current to the PUTs 20-1 and 20-2 and thereby forcibly cut off the PUTs.

As the charging of the capacitor $C_{20}$ is completed, the base current of the transistor 22 is cut off to turn the latter off and thereby place it in a steady state. Additionally, the erroneous operation of the comparator 14 is prevented, because the discrimination reference voltage Vb is reduced to a substantially zero level as the transistor 22 is turned on.

This circuit for preventing the erroneous operation at the time of turning on of the power source can be equally applied to the embodiment shown in FIG. 1 which employs thyristors.

Referring to the circuit shown in FIG. 6, the initial condition is as follows. The outputs $Q_{1A}$-$Q_{4A}$ and $Q_{aB}$ of a shift register $IC_2$ (CD4015) take the low level "L", so that the inverters 2-6 assume the high level "H". In this state, the OP amplifier $IC_6$ is biased by the positive—parallel resistance of $-R_{60}$,$R_{74}$ to $R_{78-R71}$—the negative junction $J_1$.

The OP amplifier takes "L" level because no smoke is detected.

Then, as the smoke enters into the outer chamber and the potential negative of the input of OP amplifier $IC_6$ drops below the bias voltage of $J_1$, the output of the OP amplifier $IC_6$ assumes the high level "H". As a result, a gate 1 (inverter) is switched through an integration circuit which includes $R_{69}$ and $C_{65}$ to change its output from "H" to "L". As a result of the negative edge of the signal, a one-shot multivibrator $IC_1$ (CD4047) is triggered. An analogue switch $IC_5$ (CD4016) is in its conductive state because the outputs from inverters 2-6 assume the high level "H", so that an output from the one-shot multi-vibrator having a width corresponding to the time constant which is determined by the parallel resistances $R_{79}$–$R_{83}$ and a capacitor $C_{64}$ is produced This output operates to turn on a signal switching transistor 16 for the receiver, and changes the output of the inverter 1 to the "L" level. Simultaneously, the output from the $IC_1$ is delivered to the clock terminal of the shift register $IC_2$ to change the output from $Q_{1A}$ to the "H" level.

As the output of the inverter 1 is changed to "L", the bias of the OP amplifier $IC_6$ is changed by a resistor $R_{73}$ which has a small resistance value, and a large bias is applied so that the output therefrom can be temporarily changed to "L". As the output $Q_{1A}$ of the shift resister $IC_2$ changes to the "H" level, the output of the inverter 2 changes to the "L" level, so that the bias of th OP amplifier $IC_6$ is divided by parallel resistances $R_{70}$,$R_{75}$–$R_{78}$ and parallel resistances $R_{71}$,$R_{73}$,$R_{74}$. As the output of the one-shot multi-vibrator $IC_1$ is changed to the "L" level, $R_{73}$ is disconnected from the bias circuit, so that the bias is determined by the parallel resistances $R_{71}$, $R_{74}$.

As the smoke goes further into the chamber, the OP amplifier $IC_6$ is switched from the "L" level to the "H" level and likewise the transistor 16, shift register $IC_2$ and inverter 1, are triggered so that the outputs $Q_{1A}$ and $Q_{1B}$ of the shift register $IC_2$ are changed to the "H" level while the other outputs take the "L" level.

As a result, the output of the inverter 23 is switched to the "H" level, and the bilateral switch $IC_{5-1}$ is turned off. In this state, the time constant of the one-shot multivibrator $IC_1$ is determined by the parallel resistance of $C_{64}$ and $R_{80}$–$R_{83}$, so that a pulse having a larger pulse width or time length than the aforementiond pulse is produced. Simultanously, a resistance $R_{75}$ is switched from $R_{70}$ to $R_{71}$ to become parallel to the latter so as to change the bias of $J_1$.

The circuit including a PUT 61 is the reset circuit 600. As the power source of the detector is turned on, a capacitor $C_{62}$ is charged through a resistance $R_{66}$ up to a potential which is determined by potential dividing resistances $R_{66}$ and $R_{67}$ which are set to provide a potential which is greater than one half of the power source voltage. When the power source is turned on, the input of the NAND gate 2 assumes the "L" level so that the ouput from the latter assumes the "H" level to reset $IC_1$ and $IC_2$. As the charging is advanced to $C_{62}$, the output of the NAND gate is switched to the "L" level to not allow resetting.

Resetting during the course of detection takes place in the following manner. When the output $Q_{1A}$ of the shift register $IC_2$ assumes the "L" level, the outputs from NAND gates 3 and 4 assume "H" and "L" levels, respectively, so that the capacitor $C_{63}$ does not charged. Subsequently, as the output $Q_{1A}$ of the shift register $IC_2$ assumes the "H" level, the NAND gate 4 output assumes the "H" level and thereby permits the capacitor $C_{63}$ to be charged through the resistance $R_{68}$. Subsequently, when the capacitor has been charged up to a voltage in excess of the gate voltage of PUT 61, the latter is turned on to switch the input of the NAND gate 2 to the "L" level and, accordingly, to switch the output of the latter to the "H" level and thereby reset $IC_1$ and $IC_2$. Specifically, the detector is reset to the initial state when there is no output from $Q_{3A}$ within a predetermined period after the delivery of the $Q_{1A}$ output from th $IC_2$.

The detection proceeds as the output $Q_{1A}$ of $IC_2$ is switched to "H" and $Q_{2A}$ is switched to "H" so that output $Q_{3A}$ is switched to "H" within the predetermined period. The inverter 4 is switched to "L" due to the "H" level output of $Q_{3A}$ and, as a result, NAND gates 3 and 4 are switched, respectively, to "H" and "L" level so that the charging of the capacitor $C_{63}$ is stopped and the latter commences discharging through the resistance and diode. Therefore, PUT 61 is never turned on and no resetting of the device is effected.

As has been described, staged informations of different time widths or lengths are delivered from the output terminals $S_1$-$S_5$, respectively. The pair of lines is provided with a constant voltage circuit 601.

Figure 6:
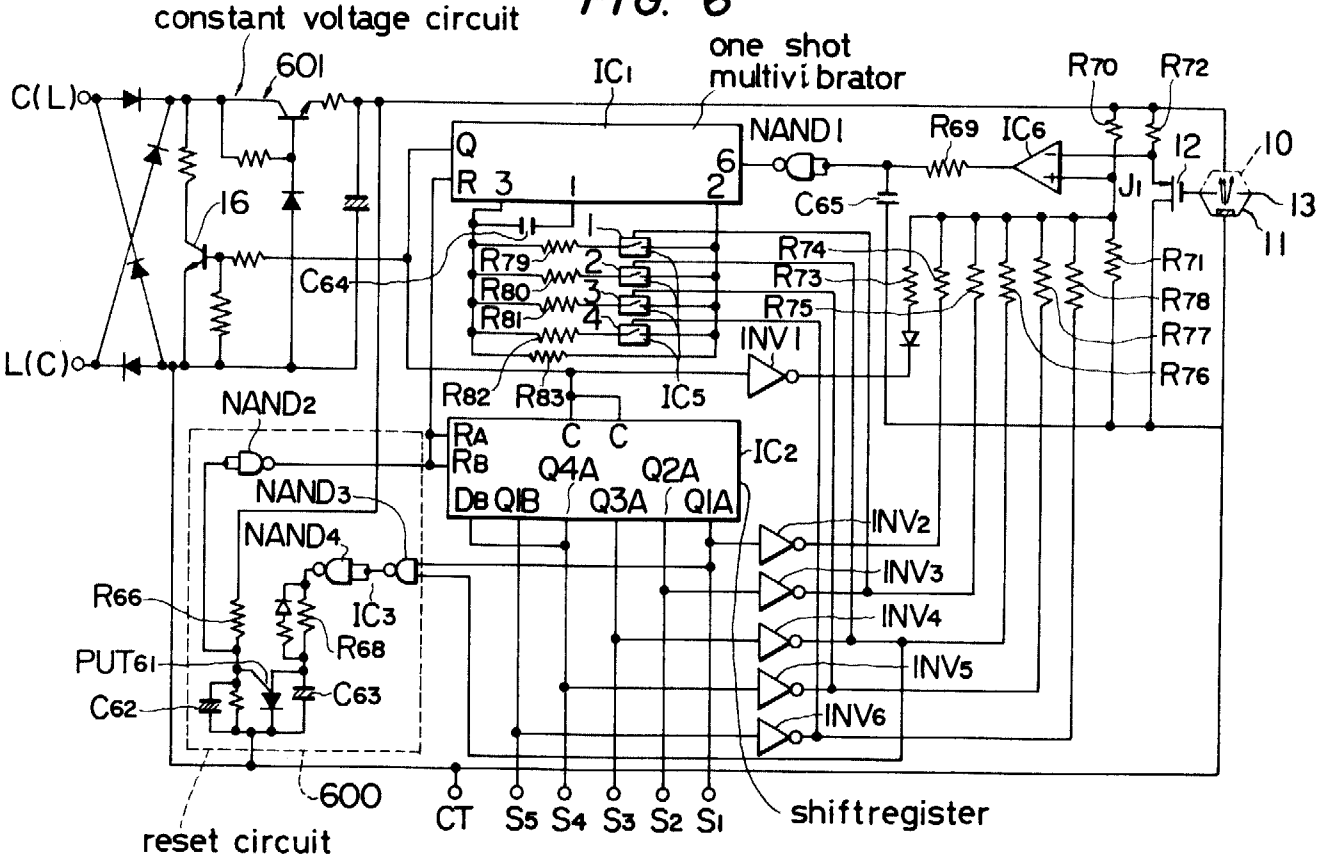
FIG. 6 is a circuit diagram of a further embodiment of the invention in which the change of the reference voltage is controlled by means of a shift register.
Figure 7:
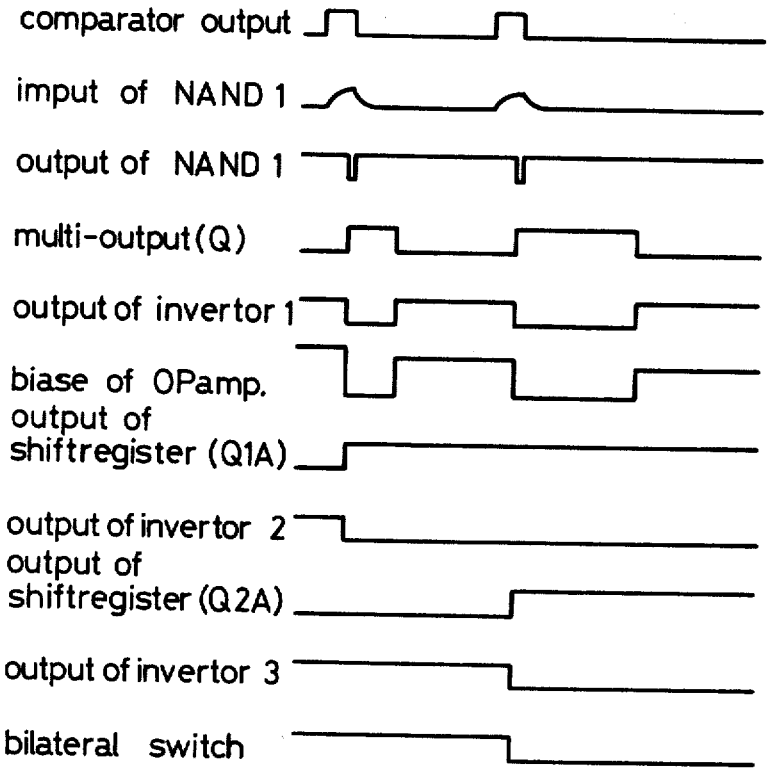
FIG. 7 is a time chart of operation of the circuit shown in FIG. 6.

The operation of the circuit shown in FIG. 6 can be more clearly understood from the time chart as shown in FIG. 7.

Figure 8:
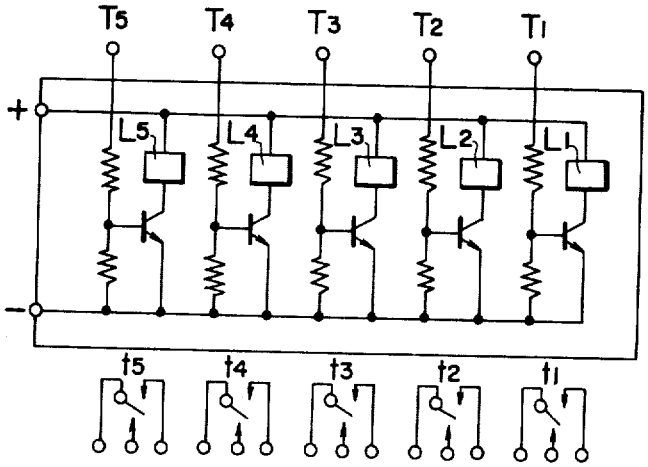
FIG. 8 is an example of a control circuit connected to the fire stage information output terminal.

FIG. 8 shows a control circuit having input terminals $T_1$-$T_5$ which are to be connected to the output terminals $S_1$-$S_5$ of the detector, respectively. Switching semiconductors to which are connected relays $L_1$-$L_5$, respectively, are adapted to be turned on by respective information outputs. As a result, corresponding movable contacts t1-t5 which are incorporated in the electric actuating means of peripheral equipment are operated.

Figure 9:
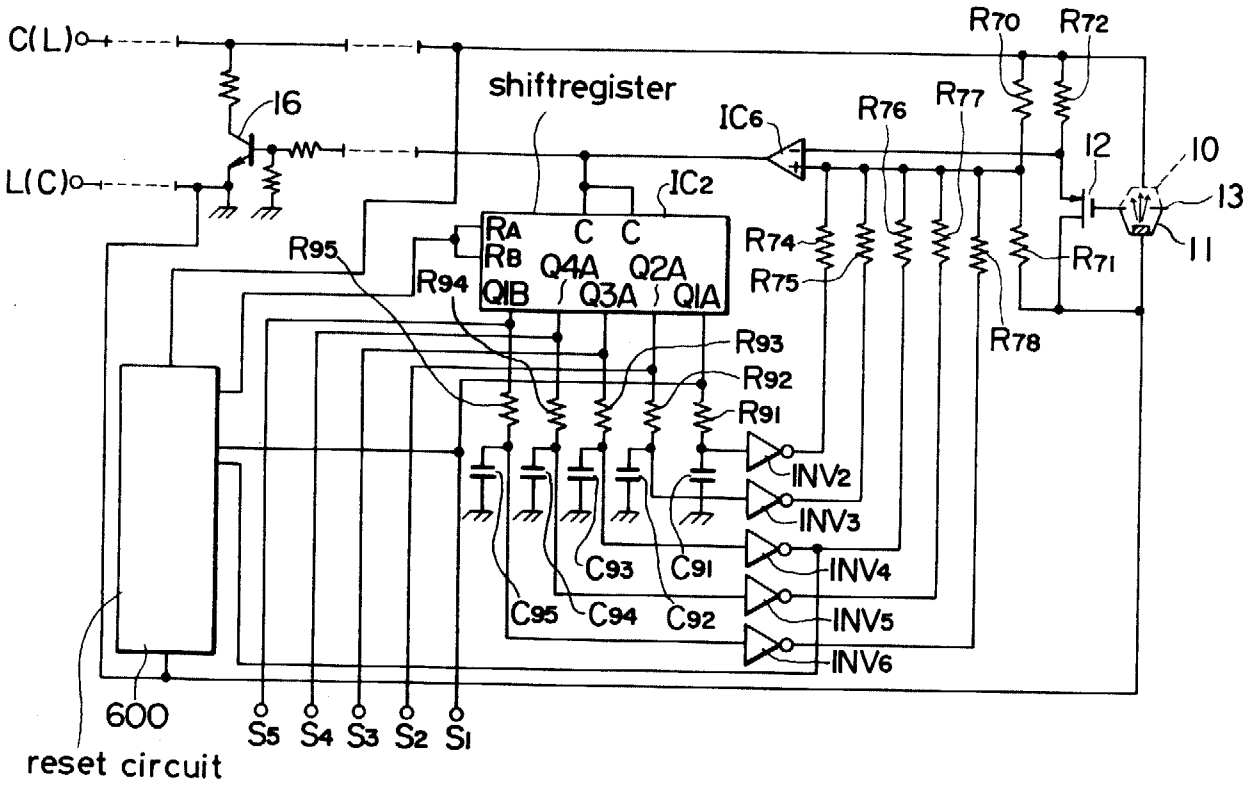
FIG. 9 is a circuit diagram of a modification of the circuit shown in FIG. 6 having a simplified circuit.

FIG. 9 shows a circuit adapted to directly apply the output from the OP amplifier $IC_6$ to the clock terminals C and C of the shift register $IC_2$. Time constant circuits making up buffers are interposed between the outputs of the dual type shift register and corresponding inverters. More specifically, between the first state outputs $Q_{1A}$-$Q_{4A}$ of the shift register and the inverters 2-5, are connected time constant circuits which are made up of $R_{91}$ and $C_{91}$, $R_{92}$ and $C_{92}$, $R_{93}$ and $C_{93}$ and $R_{94}$ and $C_{94}$, respectively. Similarly, a time constant circuit made up of $R_{95}$ and $C_{95}$ is connected between the second stage output $Q_{1B}$ of the shift register and the inverter 6. These time constant circuits provide time lags of actuation having resistances $R_{74}$-$R_{78}$ to maintain the corresponding time lengths of the output of the OP amplifier $IC_6$. As a result, pulses having time lengths thus determined are delivered from th output terminals $S_1$-$S_5$. The range of amplification of the amplifier element 12 is made to correspod to the range of change of impedance of the detector. By making use of the amplification which changes in accordance to the change of impedance which is brought about by the change in amount of the detection object, staged fire informations are obtained by gradually changing the reference voltage of the voltage differential element.

Hereinbefore, the description has been made with reference to an ion type detecter by way of example. This, however, is not exclusive, and the invention can equally be applied to other types of detectors such a photoelectric type detector a constant-temperature type detector.

As has been described, in the fire detector of the invention, a fire signal is produced when the fire detection signal corresponding to the amount of change of the physical state attributable to a fire reaches the operational level of the detector, and, simultaneously, the detector by itself lowers its sensitivity automatically. This change of sensitivity is performed over several stages depending on the first detection signal. The fire signal delivered at the respective stages of sensitivity are in the form of pulses, the widths of which are short enough to enable the receiver to discriminate between these signals. By the provision of the sensitivity changing circuit having the above-stated function, the amount of information given by a single detector is remarkably increased. In addition, it is possible to judge whether the operating detector is operating erroneously or operating as a result of an actual fire. Further, the spread of fire can be analyzed and realized by a suitable real time processing.

Thus, according to the invention, there is provided a highly reliable fire watching and alarming system capable of promptly and precisely controlling various necessary equipment, deliver an alarm, guide personnel to shelter and other functions.

What is claimed is:

1. A fire detecting system comprising:

power connecting means for connection to an electric power supply;

fire detecting means connected to said power connecting means, for detecting a quantity of combustion products generated by a fire and for generating a signal corresponding to the quantity detected, said fire detecting means having a variable electrical impedance which varies in accordance with the quantity of said product detected for correspondingly varying said generated electric signal;

a receiver;

receiver connecting means for connecting said fire detecting means to said receiver for transmitting said generated signal from said fire detecting means to said receiver;

amplifier means connected respectively to said power connecting means and said receiver connecting means, and including a collector electrode connected to said first detecting means, said amplifier means for providing a varying current, said current varying in accordance with a change in said generated signal of said first detecting means;

voltage differential responding means including, a first input terminal connected to said amplifier means for receiving a voltage potential therefrom, a second input terminal, and an output terminal for outputting a signal;

a potential dividing circuit connected at said second input terminal to said voltage differential responding means at a potential dividing point of said potential dividing circuit, said potential dividing circuit including a plurality of connectable resistance elements individually connectable to said power connecting means for providing respective different potentials from said potential dividing circuit and said potential dividing circuit transmitting said respective difference potentials to said second input of said voltage differential responding means causing said signal outputted therefrom to change;

a reference operation voltage changing circuit connected to the output terminals of said voltage differential responding means, said reference operation voltage changing circuit including at least one time constant circuit for storing said output signal from said voltage differential responding means for a specified amount of time;

at least one control circuit operatively connected to said at least one time constant circuit for selectively connecting said plurality of resistance elements to said potential dividing circuit in response to an output signal generated by said at least one time constant circuit; and a plurality of information output terminals connected to said reference operation voltage changing circuit and connected to said receiver for transmitting the output from said reference operation voltage changing circuit to said receiver.

2. A fire detecting system as defined in claim 1 further comprising a semiconductor switch connected to said power connecting means and to said receiver connecting means, and including a controlling electrode connected to said output of said voltage differential responding means, for transmitting a varying signal to said receiver in response to said output of said voltage differential responding means.

3. A fire detecting system as defined in claim 1 wherein said at least one time constant circuit of said reference operation voltage changing circuit and said at least one circuit each comprise respective pluralities of time constant circuits and control circuits which are operatively connected in parallel to said output terminal of said voltage differential responding means, said control circuits including a corresponding plurality of semiconductor switching elements having resistance elements connected in series thereto, said switching elements being adapted for being turned on by respective outputs from respective ones of said time constant circuits.

4. A fire detecting system as defined in claim 1 wherein said power connecting means and receiver connecting means comprise a pair of lines for connecting said fire detecting means between the power supply and said receiver, said pair of lines comprising a positive line and a negative line and said reference operation voltage changing circuit including a control circuit shorting means for short circuiting said second input terminal of said voltage differential responding means to said negative line in response to an output from said voltage differential responding means, said output present for a specified time period which corresponds to said quantity of said product being detected, the operation of said shorting means causing said fire detecting means to stop transmitting an output.

5. A fire detecting system as defined in claim 1 wherein the reference operation voltage changing circuit connected to said output of said voltage differential responding means comprising:

a one-shot multi-vibrator having a reset terminal, said multi-vibrator producing pulses having an increasing pulse width in response to receipt of consecutive outputs respectively from said voltage differential responding means;

a shift register having a reset terminal and output terminals, said register receiving said multi-vibrator pulses and generating corresponding outputs;

inverters connected to respective output terminals of said shift register for receiving said outputs;

said connectable resistance elements being connected to respective inverters; and said fire detecting system further comprising a reset circuit including an additional time constant circuit controlled by the first of said outputs transmitted by said shift register, said reset circuit transmitting an output to said respective reset terminals of said one-shot multi-vibrator and said shift register.

6. A fire detecting system as defined in claim 1 wherein said reference operation voltage changing circuit includes, a shift register, having a clock terminal and a reset terminal, connected to said output terminal of said voltage differential responding means;

a plurality of time constant circuits, having time constants differing from each other, connected to respective output terminals of said shift register;

a plurality of inverters, each adapted for receiving an output from respective time constant circuits;

said connectable resistance elements connected in series to output terminals of respective inverters and being connectable in parallel to said second input terminal of said voltage differential responding means; and said fire detecting system further comprising a reset circuit having a NAND circuit for receiving a signal from the first output terminal and a selected one of said output terminals from said shift register, said signal from said first one of said output terminals activating one of said time constant circuits and the signal from said selected one of said output terminals stopping operation of said one of said time constant circuits;

said reset terminal of said shift register connected to an output terminal of said reset circuit; and one of said plurality of output terminals connected to a one of said semiconductor switching elements for generating information signals at said receiver connecting means and another of said plurality of output terminals having said shift register output terminals connected thereto, for connection to various equipment, which are disposed around said detector, for actuating said equipment.

* * * * *